US011814848B2

(12) United States Patent
Delaney et al.

(10) Patent No.: US 11,814,848 B2
(45) Date of Patent: Nov. 14, 2023

(54) MOUNTING CLIP ASSEMBLY PROVIDING THERMAL BARRIER

(71) Applicant: FLYNN CANADA LTD., Mississauga (CA)

(72) Inventors: Don Delaney, Toronto (CA); Joe Baz, Oakville (CA)

(73) Assignee: FLYNN CANADA LTD., Mississauga (CA)

( * ) Notice: Subject to any disclaimer, the term of this patent is extended or adjusted under 35 U.S.C. 154(b) by 0 days.

(21) Appl. No.: 17/501,682

(22) Filed: Oct. 14, 2021

(65) Prior Publication Data

US 2023/0119188 A1 Apr. 20, 2023

(51) Int. Cl.
*E04F 13/08* (2006.01)

(52) U.S. Cl.
CPC ..... *E04F 13/0807* (2013.01); *E04F 13/0862* (2013.01)

(58) Field of Classification Search
CPC ..... E04F 13/0803; E04F 13/0805; E04F 13/0807; E04F 13/0857; E04B 2001/405
See application file for complete search history.

(56) References Cited

U.S. PATENT DOCUMENTS 4,495,741 A * 1/1985 Pasiecznik ..... E04F 13/0807 52/489.1
8,176,710 B2 5/2012 Davidson et al.
8,297,019 B2 10/2012 Lorenz
8,826,624 B2 9/2014 Van Dalen
9,677,268 B2 * 6/2017 Knight ..... E04B 1/7608
2010/0071306 A1 3/2010 Williams et al.
2011/0162319 A1 * 7/2011 Strickland ..... E04C 3/065 52/831

(Continued)

FOREIGN PATENT DOCUMENTS

CA 1242559 A 10/1988
CA 2850715 A1 11/2014
EP 2746489 A1 * 6/2014 ..... E04F 13/0801

OTHER PUBLICATIONS

Northern Facades Ltd, "ISOClip—Thermal Isolation Clip—2.0" ISO Clip", 070543 Cladding Support Systems Dec. 2, 2019; 16021-1-021219 (2 pages).

(Continued)

*Primary Examiner* — Christine T Cajilig

(57) ABSTRACT

A mounting clip assembly for attaching a girt to a substrate, includes a bracket and isolator pad. The bracket includes a substrate fastening plate for mounting the bracket to a building substrate, and a girt fastening plate protruding orthogonally outward from a first face of the substrate fastening plate. The girt fastening plate has a top edge, and a bottom edge that extends at an upward angle from the substrate fastening plate, such that the vertical fastening plate is substantially trapezoidal. A girt may be fastened to the mounting clip assembly in a first fastening region. A cavity is formed in the girt fastening plate at a location between the substrate fastening plate and the fastening region to reduce thermal conductance between the fastening region and the substrate fastening plate. The cavity is reinforced by thickening material around a periphery of the cavity. The thermal isolator pad is mountable between a second face of the substrate fastening plate and the substrate.

19 Claims, 12 Drawing Sheets

(56) References Cited

U.S. PATENT DOCUMENTS

| | | | | |
|---|---|---|---|---|
| 2015/0128518 | A1* | 5/2015 | Knight | E04F 13/0864 52/404.1 |
| 2018/0119412 | A1* | 5/2018 | Klupazek | E04F 13/0805 |
| 2019/0309514 | A1* | 10/2019 | Stahl, Jr. | E04B 2/965 |
| 2019/0368202 | A1* | 12/2019 | Lammer-Klupazek | E04F 13/007 |
| 2022/0195735 | A1* | 6/2022 | Ochi | E04F 13/0805 |

OTHER PUBLICATIONS

Northern Facades Ltd, "ISOClip—Thermal Isolation Clip—3.25" ISO Clip", 070543 Cladding Support Systems Dec. 2, 2019; 16021-1-021219 (2 pages).

* cited by examiner

MOUNTING CLIP ASSEMBLY PROVIDING THERMAL BARRIER

FIELD

This disclosure relates to creating a mounting clip assembly for mounting girts to a building exterior, and to providing a thermal break between the interior and exterior of a building, and more particularly to a mounting clip assembly providing a thermal barrier.

BACKGROUND

In modern building construction, the thickness of insulation walls may be increased by fastening a mounting clip assembly to the building exterior wall and by fastening a girt, such as a sub-girt, to the mounting clip assembly. Generally, the mounting clip assembly may be fastened to a supporting wall assembly, such as a stud wall or masonry wall assembly. In addition, the girt may be fastened vertically or horizontally to the mounting clip assembly. Façade elements may be mounted to the girt such that they are offset from the supporting wall assembly, increasing the wall's insulation thickness. Additional insulation may also be installed between the façade elements and building exterior wall to further reduce the thermal transfer through the building envelope.

Since existing mounting clip assemblies may be formed of a thermally conductive material, such as galvanized steel or aluminium, they may provide a thermally conductive path between the interior and exterior of the building, increasing the thermal transfer through the building envelope. For example, some existing mounting clip assemblies are produced of aluminium, whose high thermal conductivity makes it a poor material for reducing thermal bridging. In practice, the effective R-value ($ft^2 \cdot {}^\circ F. \cdot h/BTU$) of a mounting clip assembly may represent its thermal resistance, which may be affected by the material composition of the mounting clip assembly, as well as its geometry and installation parameters. The mounting clip assembly installation parameters may include the insulation thickness, clip spacing and girt orientation.

As well, existing mounting clip assemblies may not accommodate for wall deviation or multiple insulation thicknesses/wall depths, thus requiring shims or multiple clip sizes, and may also only accommodate a sub-girt installed in a single orientation. For example, the mounting clip assembly may only accommodate a sub-girt fastened to the mounting clip assembly in a horizontal orientation, or may only accommodate a sub-girt fastened in a vertical orientation if the mounting clip assembly itself is fastened in a different orientation to the building interior.

Accordingly, there is a need for an improved mounting clip assembly.

SUMMARY

In an embodiment, a mounting clip assembly for attaching a girt to a substrate, includes a bracket and isolator pad. The bracket includes a substrate fastening plate for mounting the bracket to a building substrate, and a girt fastening plate protruding orthogonally outward from a first face of the substrate fastening plate. The girt fastening plate has a top edge, and a bottom edge that extends at an upward angle from the substrate fastening plate, such that the vertical fastening plate is substantially trapezoidal. A girt may be fastened to the mounting clip assembly in a first fastening region. A cavity is formed in the girt fastening plate at a location between the substrate fastening plate and the fastening region to reduce thermal conductance between the fastening region and the substrate fastening plate. The cavity is reinforced by thickening material around a periphery of the cavity. The thermal isolator pad is mountable between a second face of the substrate fastening plate and the substrate.

In an embodiment, a mounting clip assembly for attaching a girt to a substrate includes: a bracket having a substrate fastening plate and a girt fastening cantilever protruding orthogonally from a first face of the substrate fastening plate. The girt fastening cantilever includes a vertical fastening plate and a horizontal fastening plate. The horizontal fastening plate is disposed orthogonally to the vertical fastening plate. The horizontal fastening plate includes a first fastening region for fastening a girt in a horizontal orientation to the mounting clip assembly. The vertical fastening plate includes a bottom edge that extends at an upward angle from the substrate fastening plate, such that the vertical fastening plate is substantially trapezoidal. A second fastening region allows fastening a girt in a vertical orientation to the mounting clip assembly. A cavity is formed in the vertical fastening plate at a location between the substrate fastening plate and the second fastening region to reduce thermal conductance between the second fastening region and the substrate fastening plate. The cavity is reinforced. A thermal isolator pad is mountable between the substrate fastening plate and the substrate.

The horizontal fastening plate may further, optionally, include a cut-out.

In a further embodiment, the cut-out is formed in the horizontal fastening plate at a location between the substrate fastening plate and the first fastening region to limit thermal conductance between the first fastening region and the substrate fastening plate.

Other features will become apparent from the drawings in conjunction with the following description.

BRIEF DESCRIPTION OF THE DRAWINGS

In the figures which illustrate example embodiments.

DETAILED DESCRIPTION

Figure 1A:
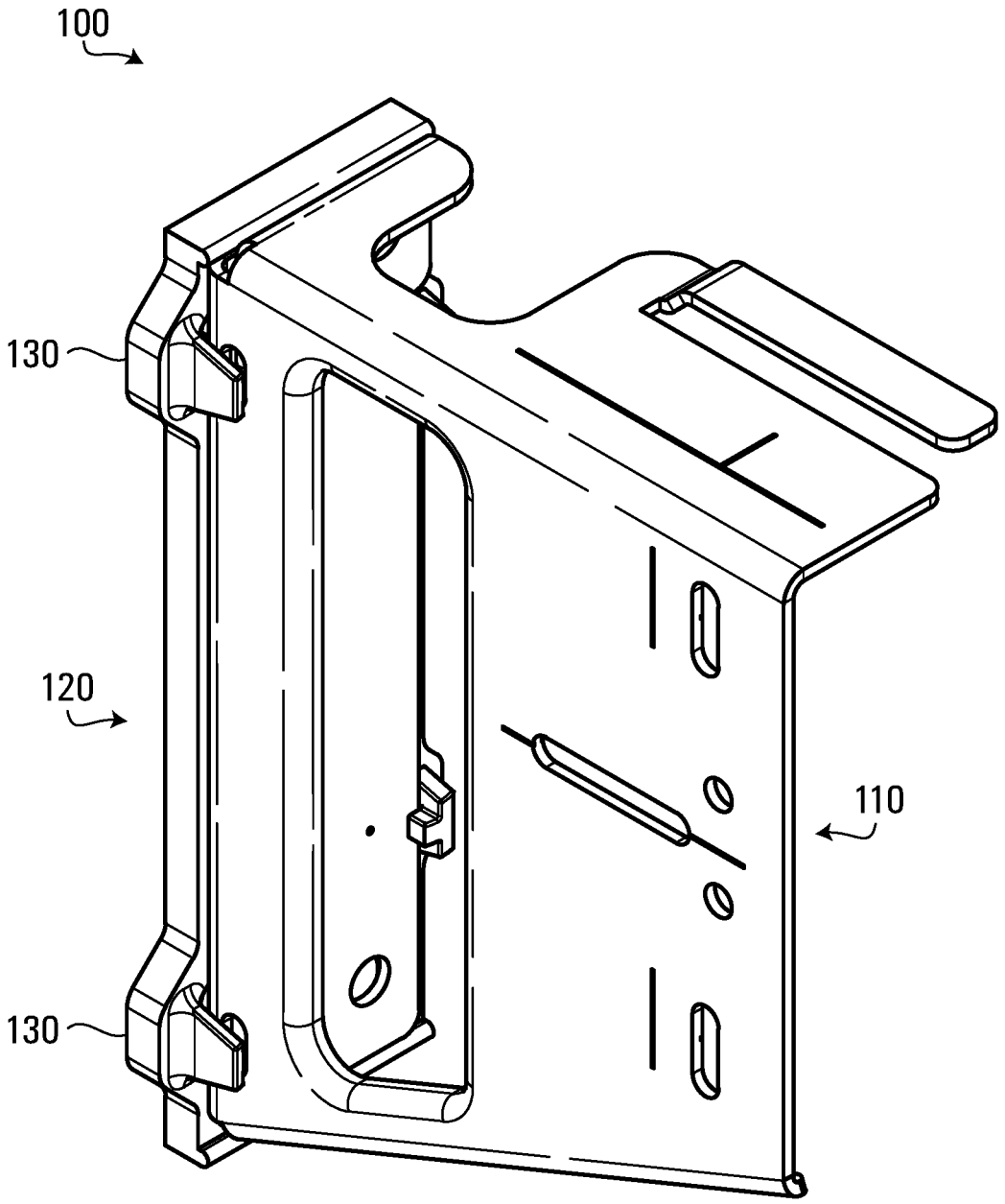
FIGS. 1A-1C are perspective views of a mounting clip assembly, exemplary of an embodiment.
Figure 1B:
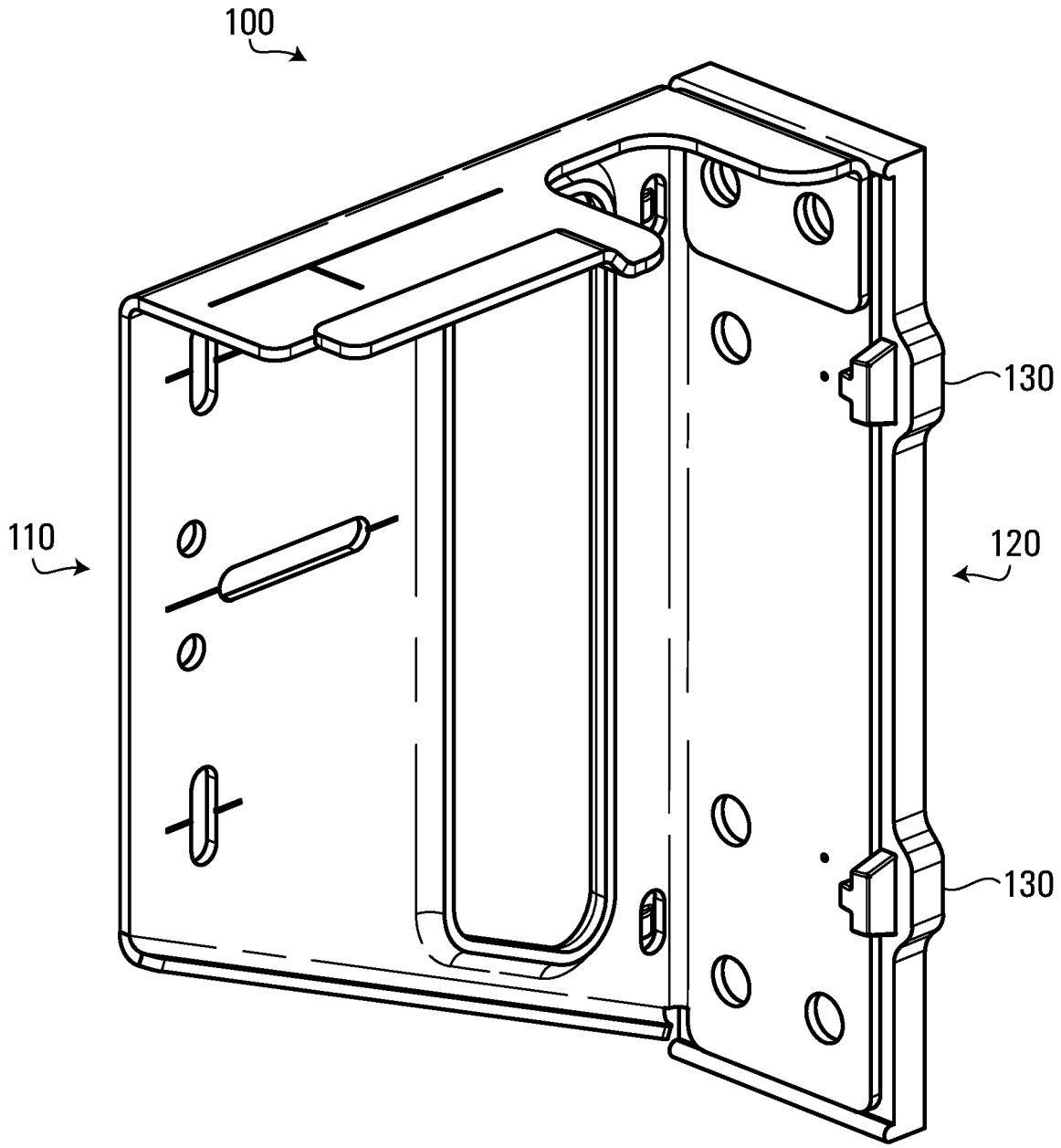
Figure 1C:
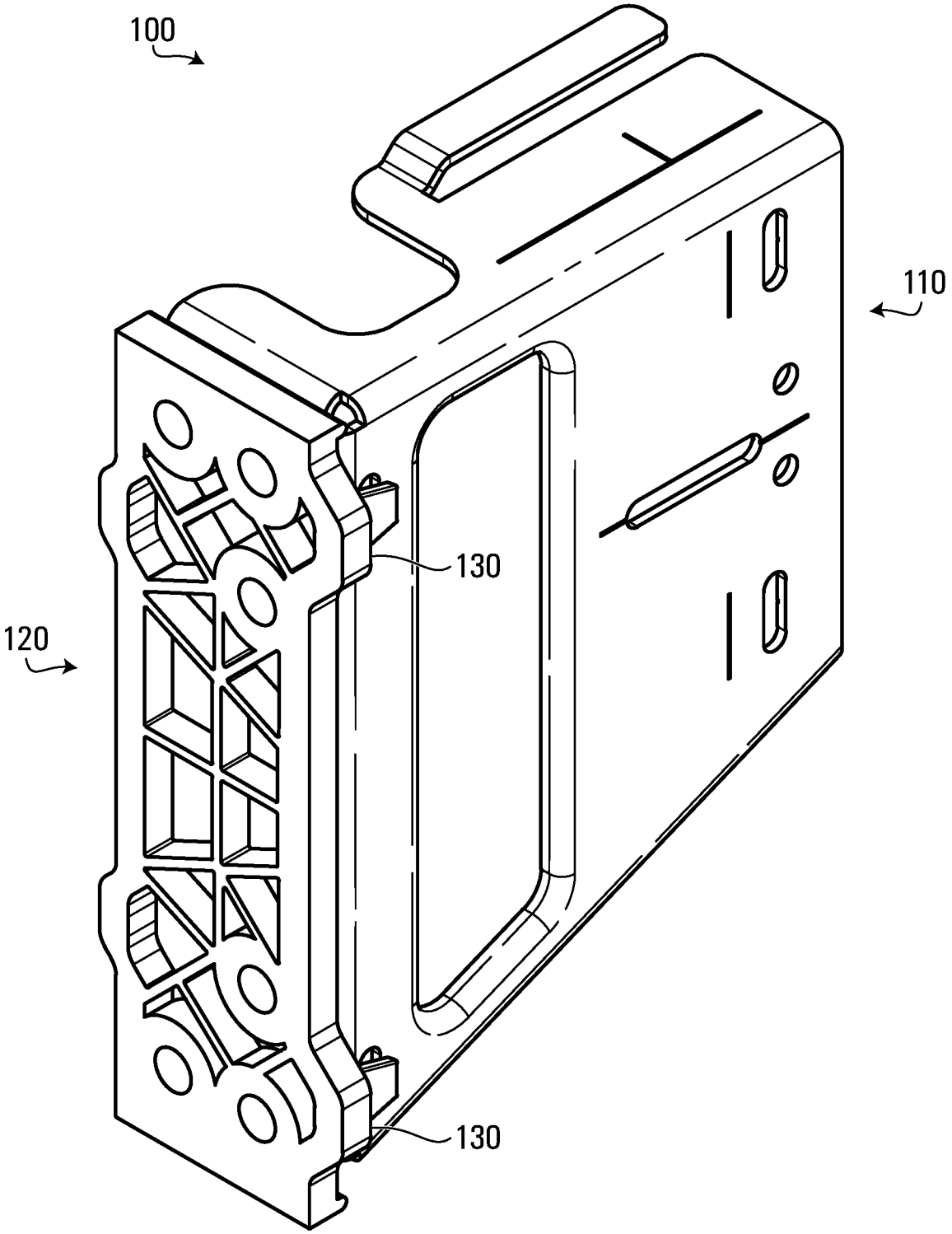
Figure 2A:
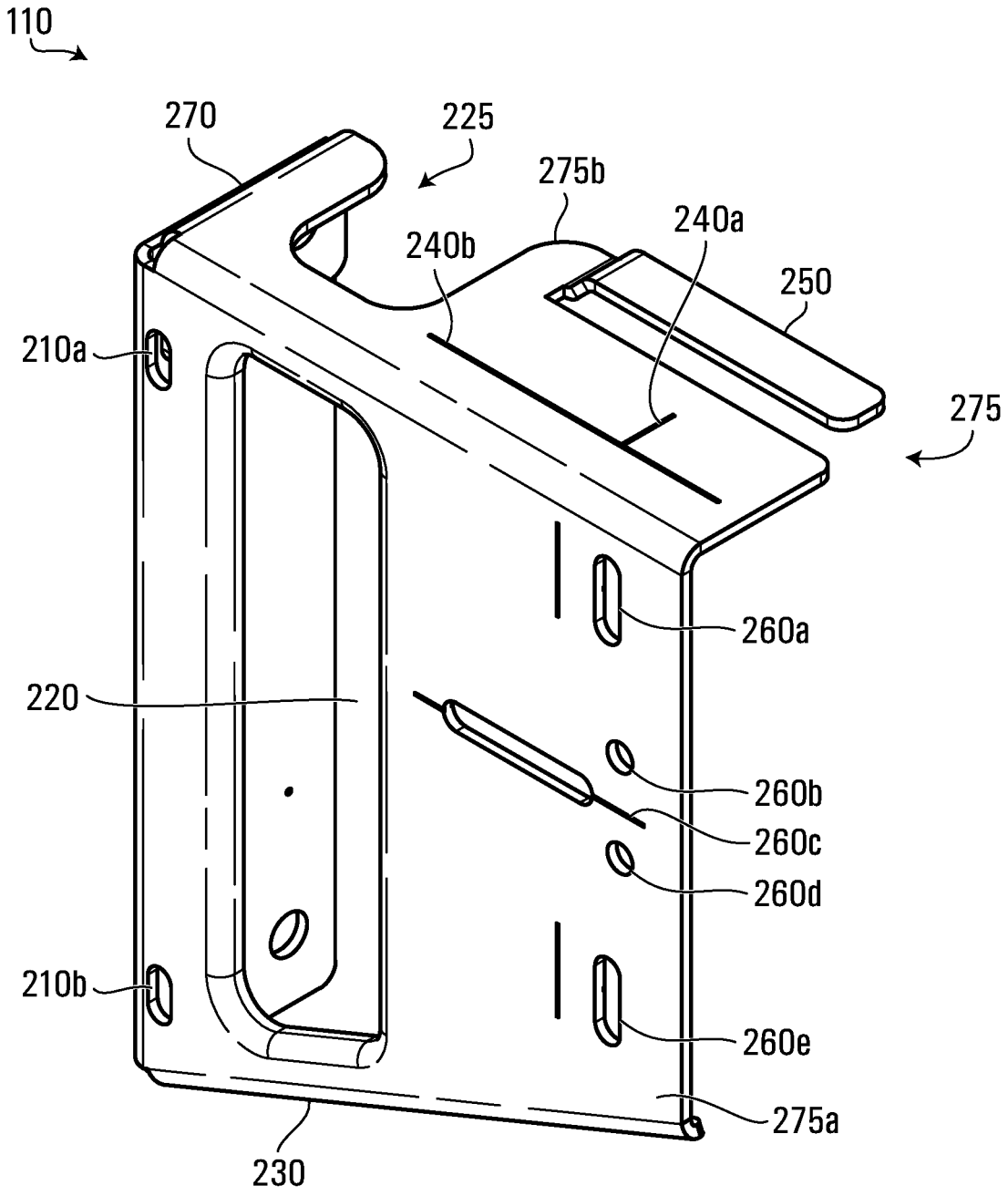
FIGS. 2A-D are perspective views and an elevated view of a bracket in the mounting clip assembly of FIGS. 1A-1C.
Figure 2B:
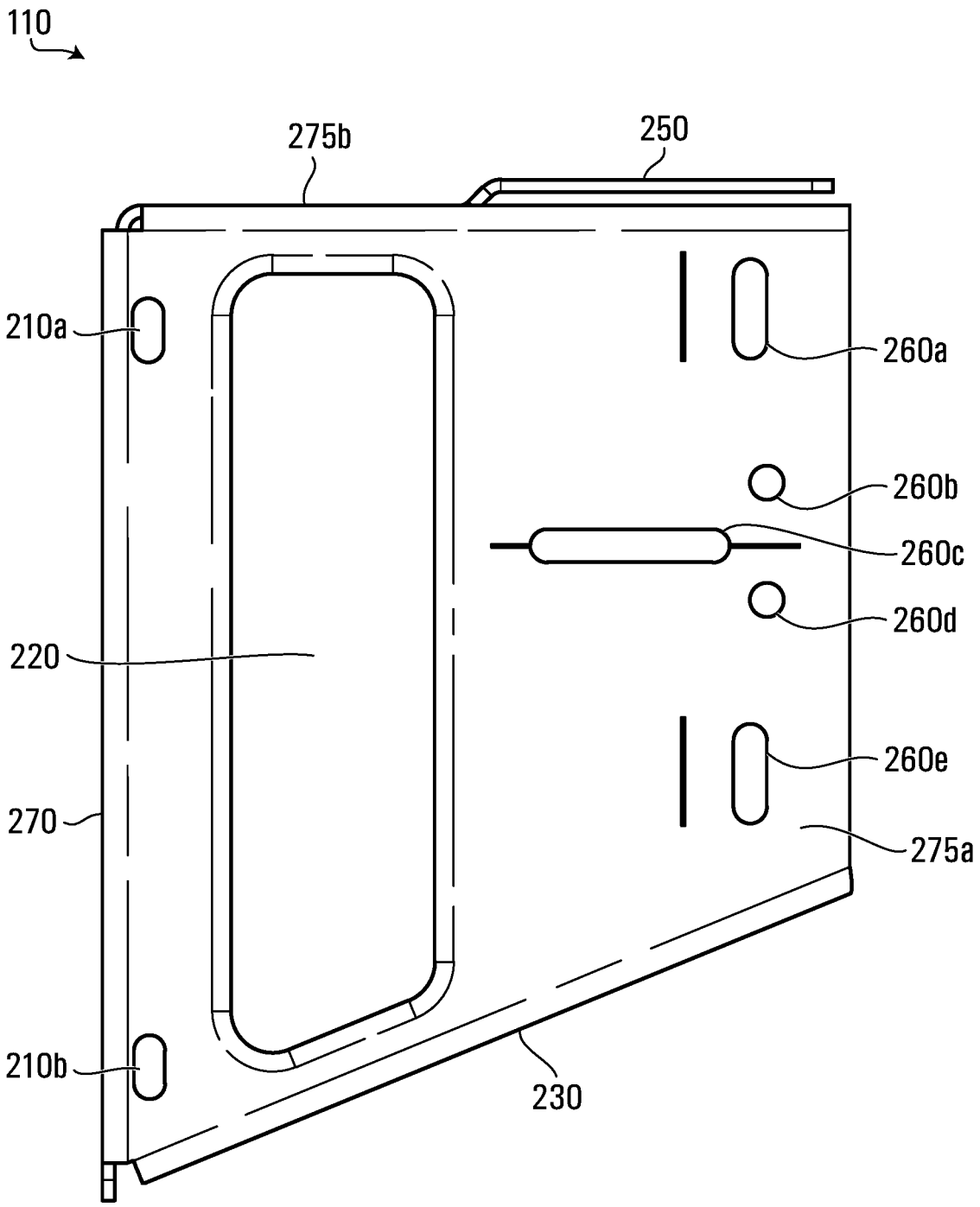
Figure 2C:
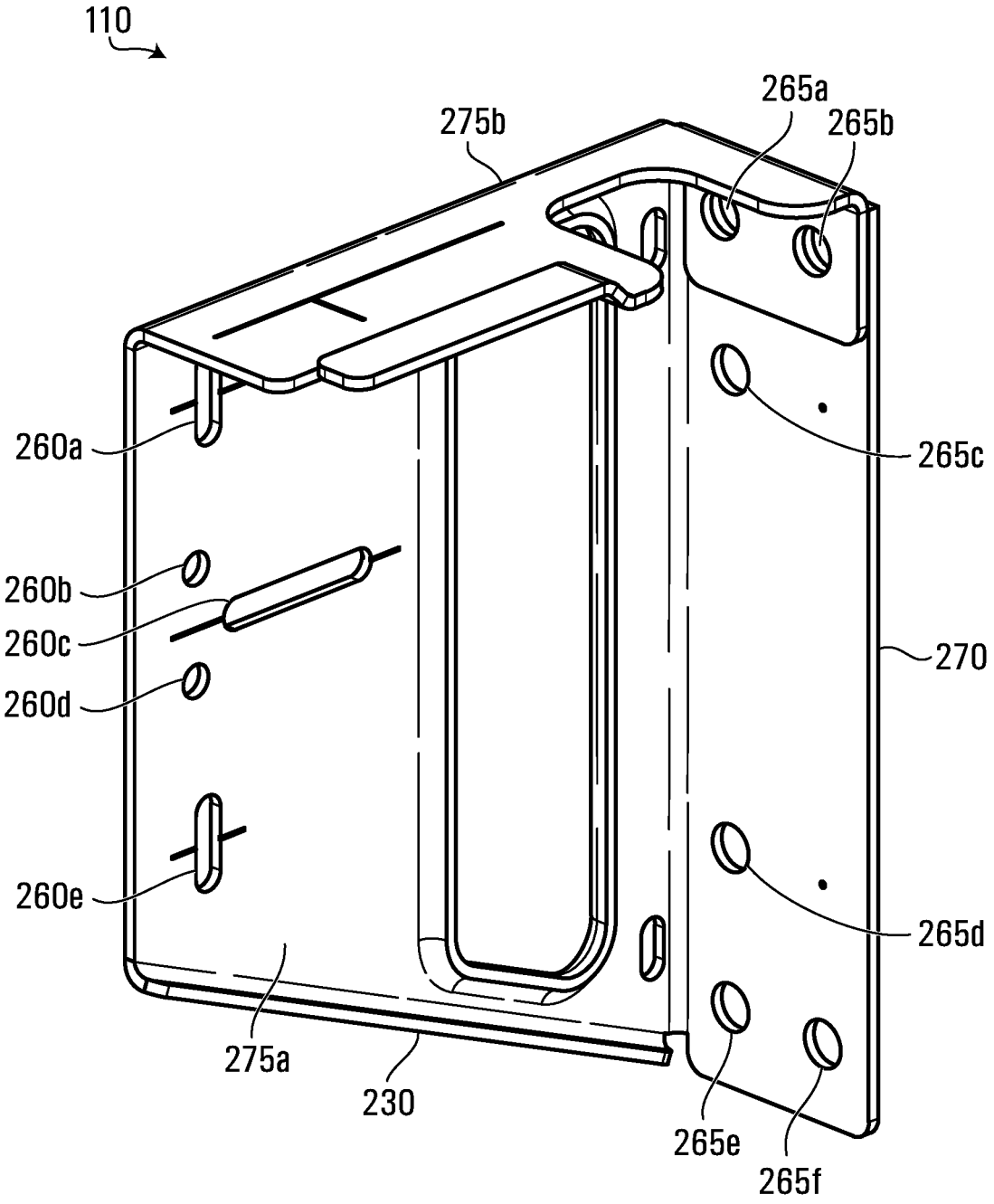
Figure 2D:
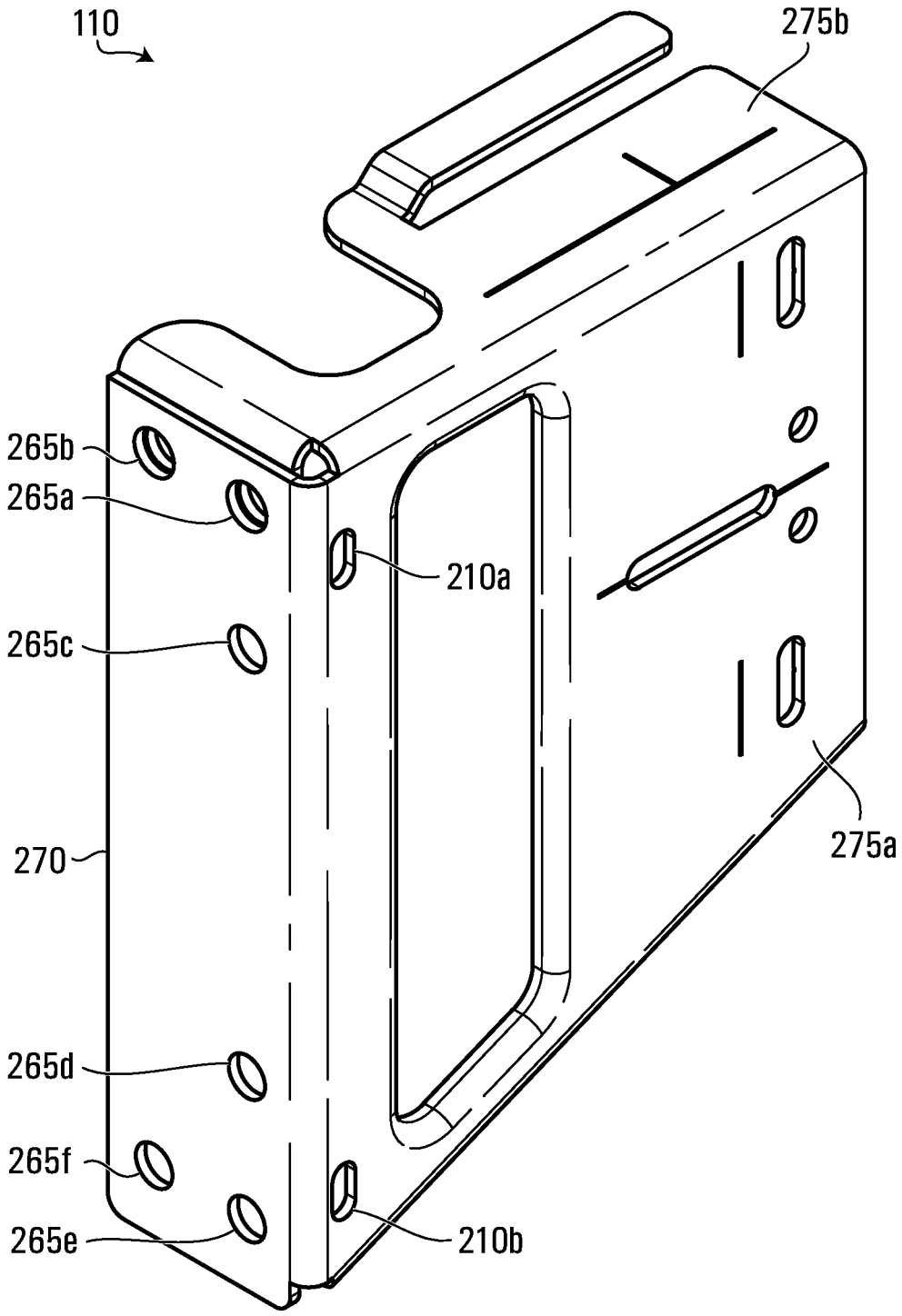

FIGS. 1A-1C depict a mounting clip assembly 100, exemplary of an embodiment. Mounting clip assembly 100 includes a bracket 110 and a thermal isolator pad 120. Thermal isolator pad 120 may be connected to bracket 110 using clip interface 130.

Mounting clip assembly 100 may be fastened to a substrate. For example, bracket 110 and thermal isolator pad 120 may be fasted to concrete, concrete block, steel studs or wood. For steel studs, mounting clip assembly 100 may be fastened through a building's exterior sheathing directly to the steel stud. In addition, a sub-girt may be fastened to mounting clip assembly 100. For example, a sub-girt may be fastened horizontally or vertically to bracket 110. Moreover, mounting clip assembly 100 may accommodate a sub-girt fastened either horizontally or vertically, even while mounting clip assembly 100 remains in the same orientation.

FIGS. 2A-2D depict bracket 110, which may be formed of one or more materials, such as metal or alloy. For example, bracket 110 may be formed of galvanized steel, galvalume steel, or stainless steel. In alternate embodiments, bracket 110 may be formed of another metal or an alloy, such as ZAMAK. Bracket 110 includes a substrate fastening plate 270 and a girt fastening cantilever 275. Girt fastening cantilever 275 may protrude orthogonally from a face of substrate fastening plate 270. For example, girt fastening cantilever 275 may protrude from one or more edges of substrate fastening plate 270. Girt fastening cantilever 275 may include one or more girt fastening plates, and may, for example, include a vertical fastening plate 275*a* and a horizontal fastening plate 275*b*, and horizontal fastening plate 275*b* may be disposed orthogonally to vertical fastening plate 275*a*. For example, vertical fastening plate 275*a* may protrude from a side edge of substrate fastening plate 270 and horizontal fastening plate 275*b* may protrude from a top edge of the vertical fastening plate 275*a*.

Bracket 110 may be a unitary piece of steel, such that substrate fastening plate 270 and girt fastening cantilever 275 may be formed out of the same unitary piece of steel. For example, bracket 110 may be formed out of a unitary sheet of material (e.g. steel), which may be punched and folded, such that substrate fastening plate 270 and girt fastening cantilever 275 may be formed. Thus, cantilever 275 may be folded or bent such that vertical fastening plate 275*a* and horizontal fastening plate 275*b* may also be formed out of the same unitary cut or stamped piece of steel. In further embodiments, after bracket 110 is folded from a unitary sheet of steel, it may be spot welded to close any seams. In an embodiment, the sheet of steel has a uniform thickness of between 0.043 in and 0.1 in.

In an alternate embodiment, bracket 110 may be formed of one or more pieces of steel, which may each be punched, folded and spot welded together. For example, girt fastening cantilever 275 may be formed from a blank—formed as a unitary sheet of steel—which may be punched, folded into shape, and spot welded to form substrate fastening plate 270.

Girt fastening cantilever 275 may include a first fastening region for fastening a girt in a horizontal orientation to mounting clip assembly 100 formed in horizontal fastening plate 275*b*. First fastening region may be located at the end of horizontal fastening plate 275*b* farthest from substrate fastening plate 270. At first fastening region, horizontal fastening plate 275*b* may include a girt fastening slot 250. Girt fastening slot 250 may be rectangular in shape and may be elevated from the surface of horizontal fastening plate 275*b*, such that a sub-girt installed in a horizontal orientation may fit between girt fastening slot 250 and the surface of horizontal fastening plate 275*b*. Girt fastening slot 250 may also serve as a helping hand, used as an additional aid to temporarily hold a sub-girt. For example, girt fastening slot 250 may act as a clamp, which may temporarily hold a sub-girt in place while the sub-girt is fixed to mounting clip assembly 100, such as with screws.

Vertical fastening plate 275*a* may be rectangular, triangular or trapezoidal in shape. For example, vertical fastening plate 275*a* may have a cantilever bottom edge 230 that extends at an upward angle from substrate fastening plate 270, such that vertical fastening plate 275*a* is substantially trapezoidal. Cantilever bottom edge 230 may act as an integrated diagonal brace, providing additional structural integrity to mounting clip assembly 100. Cantilever bottom edge 230 may also be reinforced for further structural integrity, such as by flanging cantilever bottom edge 230. Cantilever bottom edge 230 may extend upwardly at an angle of between 60° and 90° from vertical fastening plate 275.

Vertical fastening plate 275*a* may include a second fastening region for fastening a girt in a vertical orientation to mounting clip assembly 100. Second fastening region may be located at the end of vertical fastening plate 275*a* farthest from substrate fastening plate 270. At second fastening region, vertical fastening plate 275*a* may also include pre-punched holes 260*a*-260*e*. In other embodiments, vertical fastening plate 275*a* may include fewer or more pre-punched holes than pre-punched holes 260*a*-260*e*.

Vertical fastening plate 275*a* may also include one or more cavities—like cavity 220, which may be formed in vertical fastening plate 275*a* at a location between substrate fastening plate 270 and second fastening region to limit thermal conductance between second fastening region and substrate fastening plate 270. As used the term cavity refers to a void, formed as a hole, cut-out or in some other manner in a generally thin plate. Cavity 220 may remove conductive material from vertical fastening plate 275*a*—effectively providing an air gap that extends in the outward direction (i.e. away from substrate fastening plate 270) on the face of vertical fastening plate 275*a*. Cavity 220 may have an area between 10% and 55% of the area of vertical fastening plate 275*a*. Alternatively, cavity 220 may be between 23% and 53% of the area of vertical fastening plate 275*a*. Moreover, cavity 220 may be disposed between both first and second fastening regions and substrate fastening plate 270, such that when a sub-girt is installed either in a horizontal or vertical orientation to mounting clip assembly 100, cavity 220 may interpose between the sub-girt and the substrate that mounting clip assembly 100 is fastened against. As will be appreciated, cavity 220 may thus act as thermal insulating region, and reduce the thermal conductance between substrate fastening plate 270 and the sub-girt, which may be installed either in a horizontal or vertical orientation to mounting clip assembly 100.

Cavity 220 may also be reinforced for additional structural integrity, so as not to compromise the structural integrity of girt cantilever 275 as conductive material is removed from bracket 110. Cavity 220 may be reinforced by thickening the material forming cavity fastening plate 275*a* around the periphery of cavity 220. For example, cavity 220 may include a stiffening flange, which may be formed by folding over the edges of cavity 220. The stiffening flange may be continuous around the periphery of cavity 220. In alternate embodiments, the stiffening flange may extend only partially around the periphery of cavity 220. The flange is long enough to allow a proper fold or bend. In the depicted embodiment, the flange length is about three times the thickness of the material forming fastening plate 275*a* so there is enough material to bend the flange but the total flange length is not excessive. The bend radius is approximately the same as the thickness of the material. In alternate embodiments, cavity 220 may be reinforced by forming a linear bead or impression around the edges of cavity 220, or by forming a linear bead or impression on only the horizontal edges of cavity 220 or on only the vertical edges of cavity 220. Alternatively, cavity 220 may be reinforced by spot welding additional metal or stamping thicker metal around all or some of the edges of cavity 220.

In further embodiments, cavity 220 may be reinforced with cross members in cavity 220, which may also be formed of metal or an alloy, such as by punching vertical fastening plate 275*a* or spot welding additional metal or an alloy to cavity 220. For example, if cavity 220 is formed by stamping a sheet of steel, cross members in cavity 220 may be formed by the stamping pattern, such that the edges of cavity 220 and the cross members in cavity 220 are part of the same unitary piece of steel. In other embodiments, vertical fastening plate 275*b* may include one or more additional cavities, some or all of which may be reinforced for additional structural integrity.

Horizontal fastening plate 275*b* may be rectangular in shape. Horizontal fastening plate 275*b* may also include a cut-out 225, which may remove conductive material from horizontal fastening plate 275*b*. Cut-out 225 may also be rectangular in shape and the width of cut-out 225 may be substantially similar to the width of cavity 220. In other embodiments, cut-out 225 may be triangular, circular or trapezoidal in shape. In further embodiments, horizontal fastening plate 275*b* may include one or more additional cut-outs, each of which may be rectangular, triangular, circular or trapezoidal in shape.

In such embodiments, cut-out 225, or additional cut-outs in horizontal fastening plate 275*b*, may each also be reinforced for additional structural integrity, so as not to compromise the structural integrity of horizontal fastening plate 275*b* as conductive material is removed from bracket 110. For example, cut-out 225 may include a stiffening flange, which may be formed by folding over the edges of cut-out 225 around the periphery of cut-out 225. In alternate embodiments, cut-out 225 may be reinforced by forming a linear bead or impression around the edges of cut-out 225, or by forming a linear bead or impression on only some of the edges of cut-out 225. Alternatively, cut-out 225 may be reinforced by spot welding additional metal or stamping thicker metal around all or some of the edges of cut-out 225. In further embodiments, cut-out 225 may be reinforced with cross members in cut-out 225.

As will be appreciated, cut-out 225 may also limit the thermal conductance between substrate fastening plate 270 and the sub-girt, which may be installed either in a horizontal or vertical orientation to mounting clip assembly 100.

In an example embodiment, the length of girt fastening cantilever 275 (measured along its top straight edge) is about 4.75 in and the area of substrate fastening plate 270 is about 8.2 $in^2$. Vertical fastening plate 275*a* has an area of about 13 $in^2$. The area of horizontal fastening plate 275*b* is about 4.9 $in^2$. In a further embodiment, the length of girt fastening cantilever 275 is about 7.75 in and the area of substrate fastening plate 270 is about 8.2 $in^2$. Vertical fastening plate 275*a* has an area of about 17.5 $in^2$. And, the area of horizontal fastening plate 275*b* is about 7.7 $in^2$.

Cut-out 225 may be substantially aligned with cavity 220, such that the thermally conductive material between cut-out 225 and cavity 220 is significantly reduced. In this way, the thermal resistance of girt fastening cantilever 275 and thus the effective R-value of mounting clip assembly 100 may also be significantly increased. For example, when a sub-girt is installed either in a horizontal or vertical orientation to mounting clip assembly 100, cavity 220 and thus cut-out 225 may interpose between the sub-girt and the substrate that mounting clip assembly 100 is fastened against. This may increase the thermal resistance between the sub-girt and the substrate that mounting clip assembly 100 is fastened against.

In further embodiments, substrate fastening plate 270 may also include a cut-out, which may be between 20% and 60% of the area of substrate fastening plate 270.

As will be appreciated, bracket 110 may include features that remove conductive material from bracket 110, thus reducing the thermal conductivity of mounting clip assembly 100, while simultaneously reinforcing bracket 110 to maintain substantially the same structural rigidity as a generic bracket without conductive material removed. Cantilever bottom edge 230, which may cause vertical fastening plate 275*a* to be trapezoidal in shape, cavity 220 and cut-out 225 may each remove conductive material from bracket 110 and thus reduce the possible thermal transfer through mounting clip assembly 100. When a temperature difference is applied to bracket 110, the heat flow through bracket 110 may be reduced by 32% compared to a generic bracket without the aforementioned features. To ensure that the structural integrity of mounting clip assembly 100 does not degrade as thermally conductive material is removed from bracket 110, cantilever bottom edge 230 may act as a diagonal brace for girt fastening cantilever 275, improving the structural integrity of bracket 110. As well, cantilever bottom edge 230 may be reinforced, such as by flanging cantilever bottom edge 230. For example, cantilever bottom edge 230 may be flanged by folding or bending cantilever bottom edge 230. Moreover, cantilever bottom edge 230 may be reinforced by spot welding additional metal or an alloy to cantilever bottom edge 230, punching a linear bead into cantilever bottom edge 230, or folding cantilever bottom edge 230 over itself to increase the thickness of cantilever bottom edge 230. Furthermore, girt fastening cut-out 225 and cavity 220 may be reinforced for additional structural integrity.

Horizontal fastening plate 275*b* may also include embossed guidelines 240*a* and 240*b*. Embossed guideline 240*a* may indicate how far along horizontal fastening plate 275*b* a girt needs to be installed. For example, embossed guideline 240*a* may indicate the minimum load bearing line, past which and toward substrate fastening plate 270 a girt may be installed safely. Embossed guideline 240*b* may indicate where to fasten the girt into horizontal fastening plate 275*b*.

Bracket 110 may also include pre-punched slots 210*a* and 210*b*, which may form part of clip interface 130 shown in FIGS. 1A-1C. For example, pre-punched slots 210*a* and 210*b* may be disposed along the common edge of vertical fastening plate 275*a* and substrate fastening plate 270. Pre-punched slots 210*a* and 210*b* may receive clips from thermal isolator pad 120, which may fit snugly into pre-punched slots 210*a* and 210*b* and thus prevent thermal isolator pad 120 from detaching from bracket 110. In other embodiments, bracket 110 may include fewer or more pre-punched slots than pre-punched slots 210*a* and 210*b*. Correspondingly, thermal isolator pad 120 may include fewer or more clips, such that each clip may fit snugly into a pre-punched slot in bracket 110.

Substrate fastening plate 270 may also include pre-punched holes 265*a*-265*f*, which may be used to fasten bracket 110 to thermal isolator pad 120 and to a substrate, such as a steel stud.

Figure 3A:
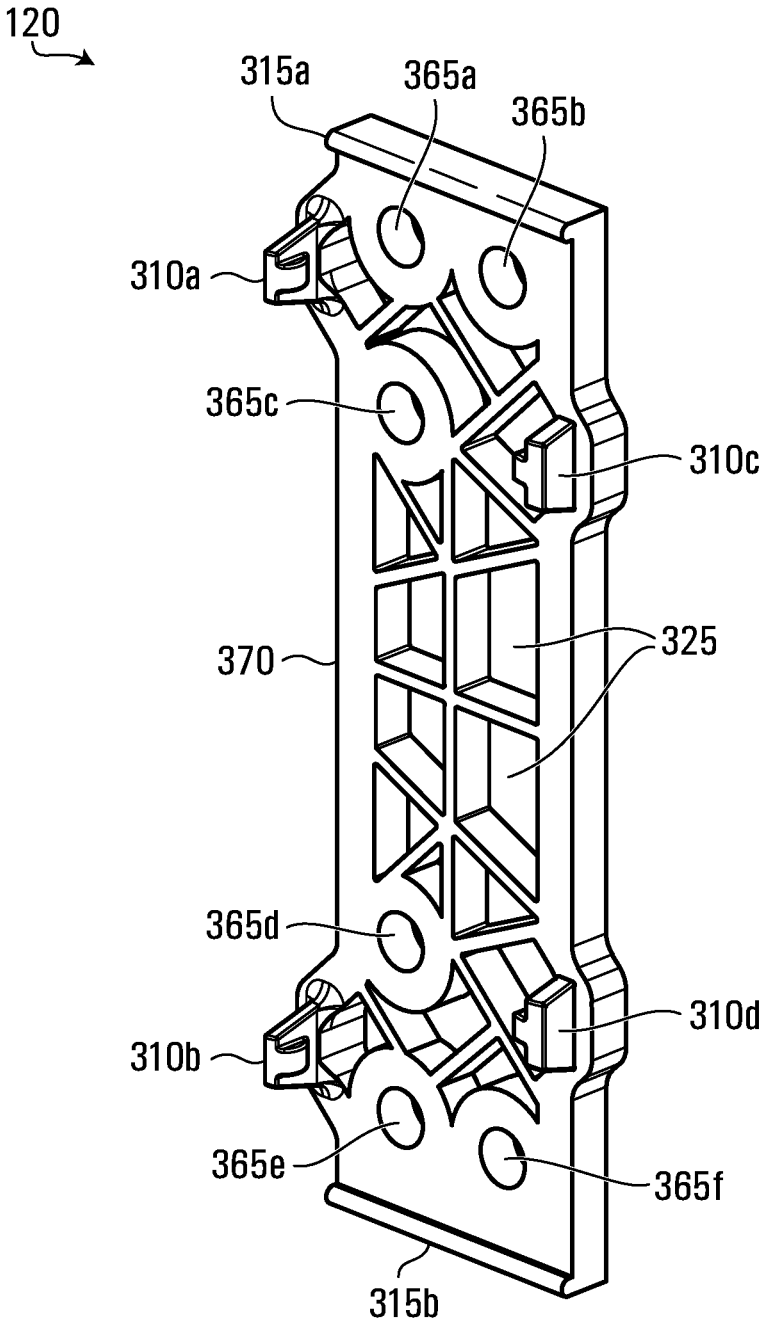
FIGS. 3A-3B are a perspective view and an elevated view of a thermal isolator pad of the mounting clip assembly of FIGS. 1A-1C.
Figure 3B:
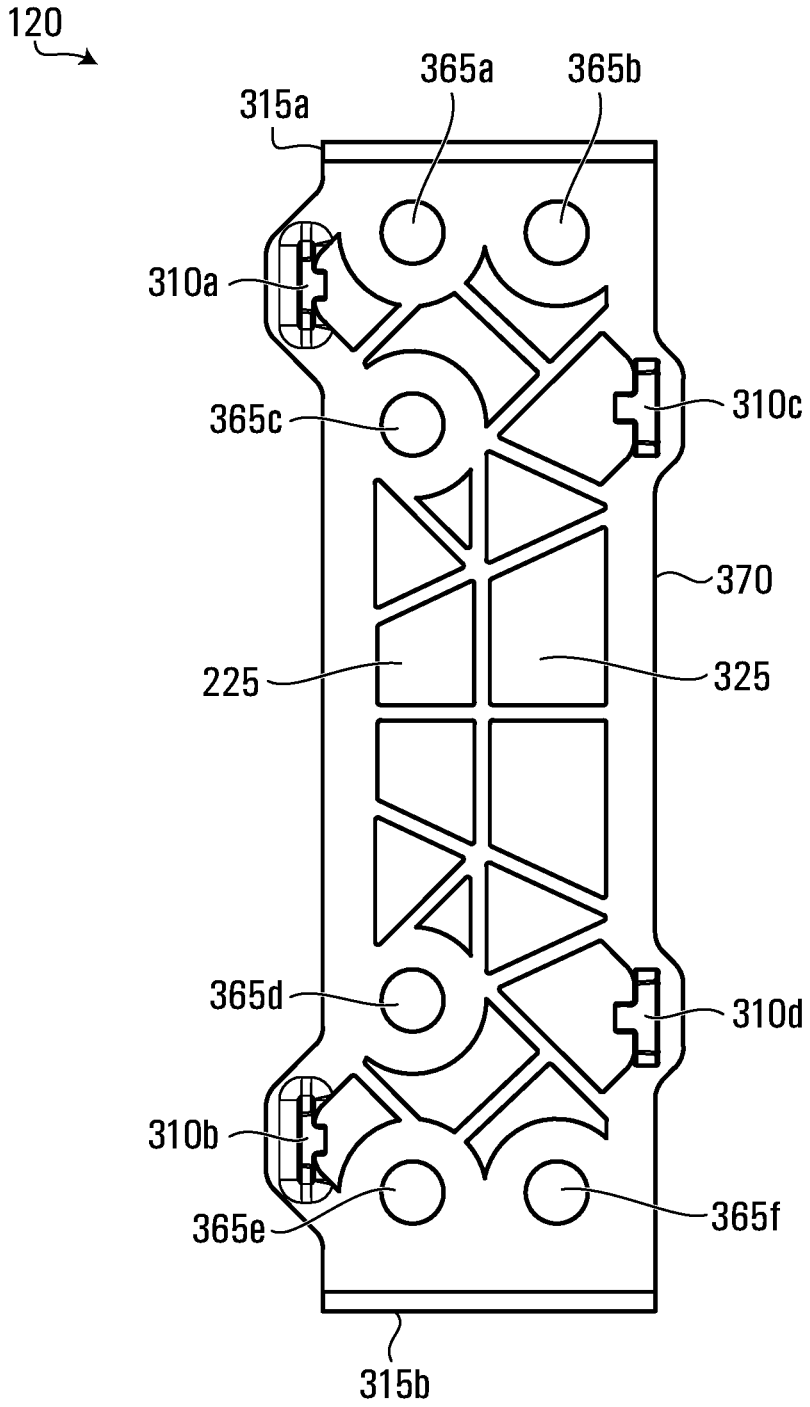

FIGS. 3A-3B depict thermal isolator pad 120, which may be mountable between substrate fastening plate 270 and a substrate. Thermal isolator pad 120 may be composed of one or more materials, such as an integral glass fibre reinforced polyamide. In other embodiments, thermal isolator pad 120 may be composed of another insulating material, such as Aerogel, high-density polyethylene (HDPE) Plastic, or Glass Fibre. Thermal isolator pad 120 includes pad base 370. Pad base 370 may include one or more pad cut-outs 325, which may reduce the thermal conductivity of thermal isolator pad 120 and thus the possible thermal transfer through mounting clip assembly 100.

Thermal isolator pad 120 may also include pad lips 315*a* and 315*b*, which may overlap with bracket 110 when thermal isolator pad 120 is fastened to bracket 110. Pad lips 315*a* and 315*b* may help keep thermal isolator pad 120 in place when fastened to bracket 110, such as by preventing thermal isolator pad 120 from sliding. In addition, thermal isolator pad 120 may include clips 310*a*-310*d*, which may form part of clip interface 130 shown in FIGS. 1A-1C. Pre-punched slots 210*a* and 210*b* in bracket 110 may receive clips 310*a* and 310*b*, which may fit snugly into pre-punched slots 210*a* and 210*b* and thus prevent thermal isolator pad 120 from detaching from bracket 110. For example, clips 310*a* and 310*b* may each include a nub protruding orthogonally from clips 310*a* and 310*b*. When clips 310*a* and 310*b* are inserted into pre-punched slots 210*a* and 210*b*, each nub protruding orthogonally from clips 310*a* and 310*b* may temporarily deform until clips 310*a* and 310*b* are fully inserted into pre-punched slots 210*a* and 210*b*. Each nub protruding orthogonally from clips 310*a* and 310*b* may thus prevent clips 310*a* and 310*b* from being removed from pre-punched slots 210*a* and 210*b* without enough force to temporarily deform each nub again. Similarly, clips 310*c* and 310*d* may also each include a nub protruding orthogonally from clips 310*c* and 310*d*. Clips 310*c* and 310*d* may clasp around an edge of bracket 110, such as an edge of substrate fastening plate 270 of bracket 110, thus further preventing thermal isolator pad 120 from detaching from backet 110. In some embodiments, clips 310*a*-310*d* may also be tapered, such that the width of clips 310*a*-310*d* is greater near the base of clips 310*a*-310*d*.

Pad base 370 may include pad holes 365*a*-365*f*, which may be used to fasten bracket 110 to thermal isolator pad 120. Pad holes 365*a*-365*f* may align with pre-punched holes 265*a*-265*f* in substrate fastening plate 270 of bracket 110, such that one or more screws may be inserted through one or more pre-punched holes 265*a*-265*f* and one or more corresponding pad holes 365*a*-365*f* to fasten bracket 110 to thermal isolator pad 120 and a substrate, such as a steel stud. To fasten bracket 110 to thermal isolator pad 120 and a substrate, it may not be necessary to insert screws through each of pre-punched holes 265*a*-265*f* and pad holes 365*a*-365*f*. For example, a screw may be inserted through pre-punched hole 265*a* and pad hole 365*a* into a steel stud, another screw may be inserted through pre-punched hole 265*c* and pad hole 365*c* into the steel stud, and a further screw may be inserted through pre-punched hole 265*e* and pad hole 365*e* into the steel stud. In other embodiments, thermal isolator pad 120 may include fewer or more pad holes than pad holes 365*a*-365*f*, and bracket 110 may correspondingly include fewer or more pre-punched holes than pre-punched holes 265*a*-265*f*. In addition, the thick ring of material around each of pad holes 365*a*-365*f* may ensure that thermal isolator pad 120 acts as a seal around the penetration of any screws inserted through a building's exterior sheathing when fastening mounting clip assembly 100 to a substrate.

Figure 4A:
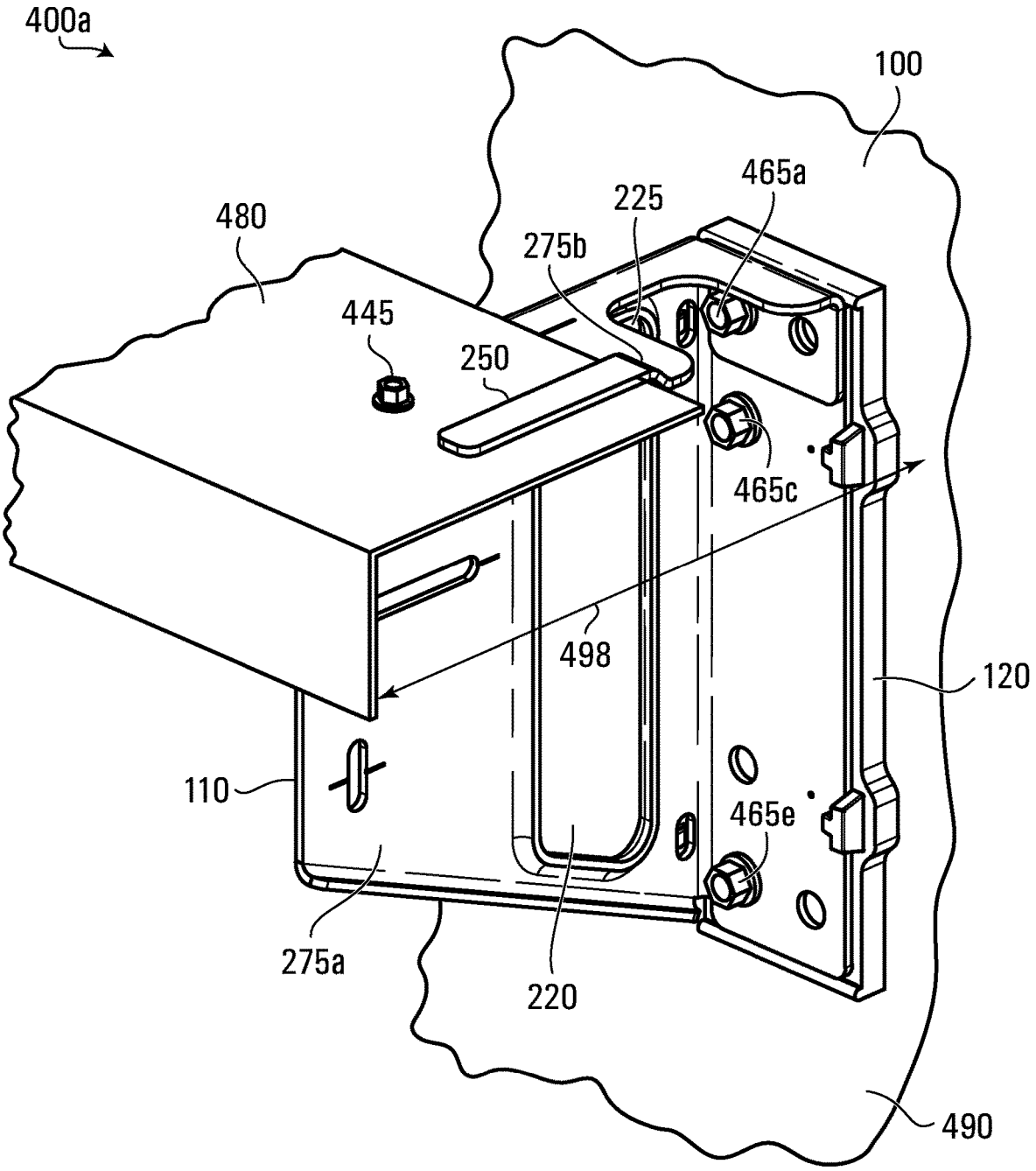
FIG. 4A is a perspective view of the mounting clip assembly of FIGS. 1A-1C installed with a sub-girt in a horizontal orientation.
Figure 4B:
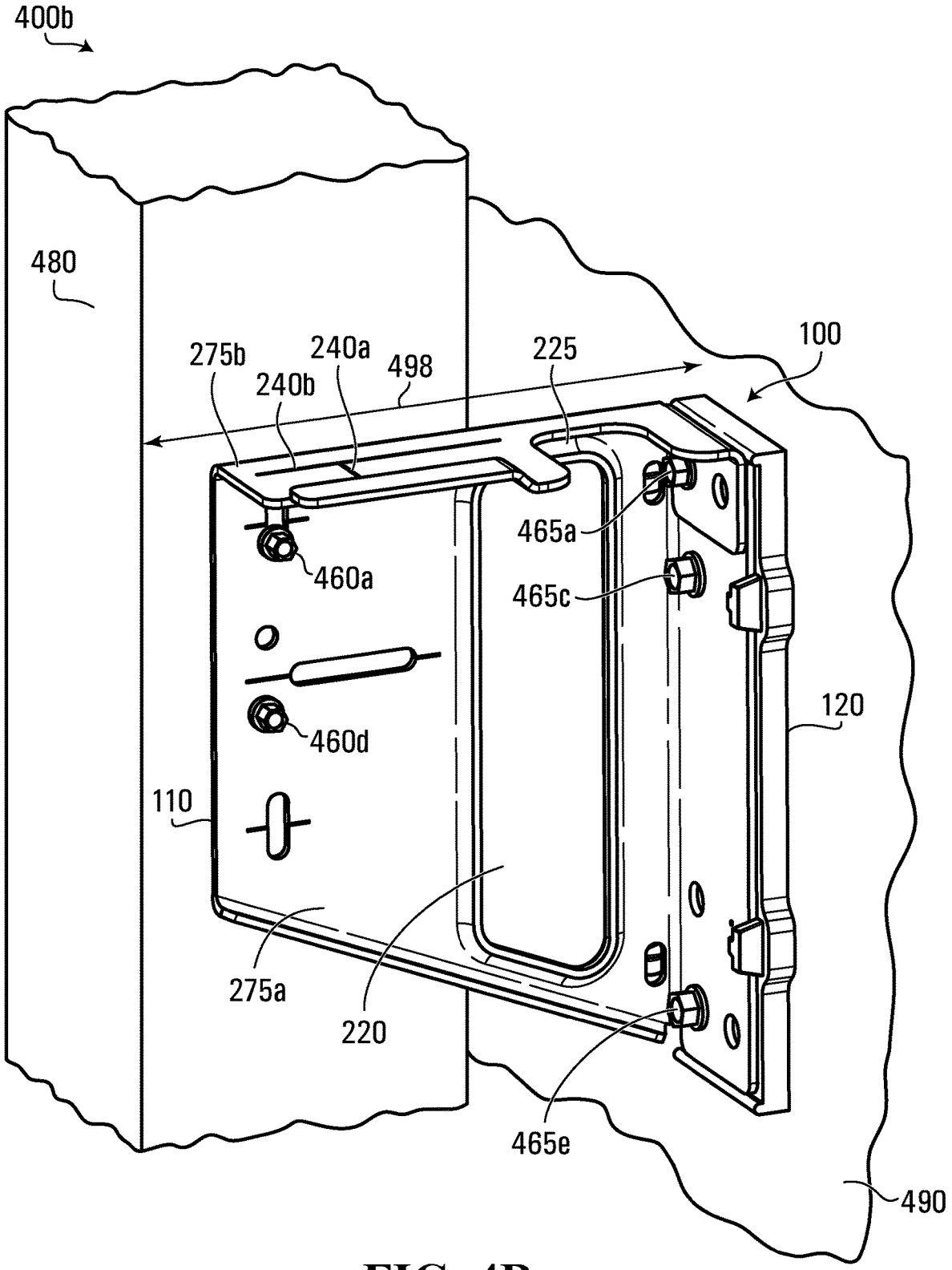
FIG. 4B is a perspective view of the mounting clip assembly of FIGS. 1A-1C installed with a sub-girt in a vertical orientation.

FIGS. 4A-4B depict how mounting clip assembly 100 installed in the same orientation can accommodate both horizontal and vertical sub-girt installation. This enables mounting clip assembly 100 to be fastened to a substrate, such as a steel stud, without having to adjust the orientation of mounting clip assembly 100 depending on the sub-girt orientation.

FIG. 4A depicts mounting clip assembly 100 installed with a sub-girt 480 in a horizontal orientation. Bracket 110 may be fastened to thermal isolator pad 120 and substrate 490 using substrate screws 465*a*, 465*c* and 465*e*. Substrate 490 may be concrete, concrete block, steel studs or wood. For example, mounting clip assembly 100 may be fastened to a steel stud using substrate screws 465*a*, 465*c* and 465*e*, which may be screwed through a building's exterior sheathing and fastened directly to the steel stud. As will be appreciated, mounting clip assembly 100 installed in the same orientation may accommodate both horizontal and vertical sub-girt installation.

Substrate screws 465*a*, 465*c* and 465*e* may be inserted through pre-punched holes 265*a*, 265*c* and 265*e* and pad holes 365*a*, 365*c* and 365*e* and screwed into the steel stud. In other embodiments, one or more additional substrate screws may be inserted through one or more of pre-punched holes 265*b*, 265*d* and 265*f* and pad holes 365*b*, 365*d* and 365*f* and screwed into the steel stud. In further embodiments, one or more of substrate screws 465*a*, 465*c* and 465*e* may be inserted through one or more of pre-punched holes 265*a*-265*f* and pad holes 365*a*-365*f* and screwed into the steel stud. As will be appreciated, mounting clip assembly 100 may be fastened to a substrate, such as a steel stud, using a variety of substrate screw fastening patterns.

Sub-girt 480 may be inserted in a horizontal orientation between girt fastening slot 250 and the surface of horizontal fastening plate 275*b*. Girt fastening slot 250 may act as a clamp, which may temporarily hold sub-girt 480 in place while sub-girt 480 is fixed to mounting clip assembly 100. Sub-girt 480 may be positioned on horizontal fastening plate 275*b* using embossed guideline 240*a*, which may indicate how far along the surface of horizontal fastening plate 275*b* sub-girt 480 needs to be installed. For example, embossed guideline 240*a* may indicate the minimum load bearing line, past which and toward substrate fastening plate 270 sub-girt 480 may be installed safely. Sub-girt 480 may be fastened to mounting clip assembly 100 in a horizontal orientation by screwing sub-girt screw 445 through sub-girt 480 and horizontal fastening plate 275*b*. Sub-girt screw 445 may be aligned on the surface of horizontal fastening plate 275*b* and sub-girt 480 using embossed guideline 240*b*, which may indicate where to fasten sub-girt screw 445 through sub-girt 480 and into horizontal fastening plate 275*b*.

Cut-out 225 and cavity 220 may be disposed between sub-girt 480 and substrate 490. Moreover, cut-out 225 may be substantially aligned with cavity 220. As will be appreciated, the thermal resistance of bracket 110 and thus the effective R-value of mounting clip assembly 100 may be significantly increased because the conductive material disposed between sub-girt 480 and substrate 490 may be significantly reduced by cut-out 225 and cavity 220. Moreover, since cut-out 225 may be substantially aligned with cavity 220, thus reducing the cross-sectional area of the thermally conductive path between sub-girt 480 and substrate 490, the thermal resistance of the portion of bracket 110 disposed between sub-girt 480 and substrate 490 may be further increased. In this way, the effective R-value of mounting clip assembly 100 may be further increased.

Moreover, the effective R-value of mounting clip assembly 100 may also be increased by increasing the length of girt fastening cantilever 275. For example, since the length of the conductive material disposed between sub-girt 480 and substrate 490 may be increased, the thermal resistance of the thermally conductive path between sub-girt 480 and substrate 490 may also be increased.

Mounting clip assembly 100 may accommodate an assembly insulation thickness 498, measured from substrate 490 to the farthest opposing edge of sub-girt 480, between 2 in to 10 in. In other embodiments, mounting clip assembly 100 may accommodate assembly insulation thickness 498 less than 2 in or greater than 10 in. Since the effective R-value of mounting clip assembly 100 may be increased by increasing the length of girt fastening cantilever 275, the effective R-value of mounting clip assembly 100 may also be increased by increasing assembly insulation thickness 498. For example, for an assembly insulation thickness 498 of 6 in, the effective R-value of mounting clip assembly 100 may be between 19.1 $ft^{2}\cdot°$ F.·h/BTU and 43.5 $ft^{2}\cdot°$ F.·h/BTU. As will be appreciated, the effective R-value of mounting clip assembly 100 for a fixed assembly insulation thickness 498 may depend on the dimensions and dispositions of cavity 220 and cut-out 225. Moreover, the effective R-value of mounting clip assembly 100 may depend on features of the sub-girt installation. For example, for an assembly insulation thickness 498 between 5 in and 8 in, a vertical clip spacing between 24 in and 60 in, a horizontal clip spacing between 16 in and 32 in, and with a vertical sub-girt 480 and exterior insulated steel stud assembly, the effective R-value of mounting clip assembly 100 may be between 18.3 $ft^{2}\cdot°$ F.·h/BTU and 31.2 $ft^{2}\cdot°$ F.·h/BTU.

FIG. 4B depicts an alternate embodiment in which mounting clip assembly 100 is installed with sub-girt 480 in a vertical orientation. Bracket 110 may be fastened to thermal isolator pad 120 and substrate 490 using substrate screws 465*a*, 465*c* and 465*e*. Substrate 490 may be concrete, concrete block, steel studs or wood. For example, mounting clip assembly 100 may be fastened to a steel stud using substrate screws 465*a*, 465*c* and 465*e*, which may be screwed through a building's exterior sheathing and fastened directly to the steel stud. As will be appreciated, mounting clip assembly 100 installed in the same orientation may accommodate both horizontal and vertical sub-girt installation.

Substrate screws 465*a*, 465*c* and 465*e* may be inserted through pre-punched holes 265*a*, 265*c* and 265*e* and pad holes 365*a*, 365*c* and 365*e* and screwed into the steel stud. In other embodiments, one or more additional substrate screws may be inserted through one or more of pre-punched holes 265*b*, 265*d* and 265*f* and pad holes 365*b*, 365*d* and 365*f* and screwed into the steel stud. In further embodiments, one or more of substrate screws 465*a*, 465*c* and 465*e* may be inserted through one or more of pre-punched holes 265*a*-265*f* and pad holes 365*a*-365*f* and screwed into the steel stud. As will be appreciated, mounting clip assembly 100 may be fastened to a substrate, such as a steel stud, using a variety of substrate screw fastening patterns.

Sub-girt 480 may be placed in a vertical orientation beside the outside face of vertical fastening plate 275*a*. Sub-girt 480 may be fastened in a vertical orientation to vertical fastening plate 275*a* by inserting sub-girt screws 460*a* and 460*d* through pre-punched holes 260*a* and 260*d* and screwing sub-girt screws 460*a* and 460*d* into sub-girt 480. In other embodiments, one or more additional sub-girt screws may be inserted through one or more of pre-punched holes 260*b*, 260*c* and 260*e* and screwed into sub-girt 480. In further embodiments, one or more of sub-girt screws 460*a* and 460*d* may instead be inserted through one or more of pre-punched holes 260*a*-260*e* and screwed into sub-girt 480. As will be appreciated, mounting clip assembly 100 may be fastened to sub-girt 480 using a variety of sub-girt screw fastening patterns.

Cut-out 225 and cavity 220 may be disposed between sub-girt 480 and substrate 490. Moreover, cut-out 225 may be substantially aligned with cavity 220. As will be appreciated, the thermal resistance of bracket 110 and thus the effective R-value of mounting clip assembly 100 may be significantly increased because the conductive material disposed between sub-girt 480 and substrate 490 may be significantly reduced by cut-out 225 and cavity 220. Moreover, since cut-out 225 may be substantially aligned with cavity 220, thus reducing the cross-sectional area of the thermally conductive path between sub-girt 480 and substrate 490, the thermal resistance of the portion of bracket 110 disposed between sub-girt 480 and substrate 490 may be further increased. In this way, the effective R-value of mounting clip assembly 100 may be further increased.

Moreover, the effective R-value of mounting clip assembly 100 may also be increased by increasing the length of girt fastening cantilever 275. For example, since the length of the conductive material disposed between sub-girt 480 and substrate 490 may be increased, the thermal resistance of the thermally conductive path between sub-girt 480 and substrate 490 may also be increased.

Mounting clip assembly 100 may accommodate an assembly insulation thickness 498, measured from substrate 490 to the farthest opposing edge of sub-girt 480, between 2 in to 10 in. In other embodiments, mounting clip assembly 100 may accommodate assembly insulation thickness 498 less than 2 in or greater than 10 in. Since the effective R-value of mounting clip assembly 100 may be increased by increasing the length of girt fastening cantilever 275, the effective R-value of mounting clip assembly 100 may also be increased by increasing assembly insulation thickness 498. For example, for an assembly insulation thickness 498 of 6 in, the effective R-value of mounting clip assembly 100 may be between 19.1 $ft^{2}\cdot°$ F.·h/BTU and 43.5 $ft^{2}$ ° F.·h/BTU. As will be appreciated, the effective R-value of mounting clip assembly 100 for a fixed assembly insulation thickness 498 may depend on the dimensions and dispositions of cavity 220 and cut-out 225. Moreover, the effective R-value of mounting clip assembly 100 may depend on features of the sub-girt installation. For example, for an assembly insulation thickness 498 between 5 in and 8 in, a vertical clip spacing between 24 in and 60 in, a horizontal clip spacing between 16 in and 32 in, and with a horizontal sub-girt 480 and exterior insulated steel stud assembly, the effective R-value of mounting clip assembly 100 may be between 18.9 $ft^{2}\cdot°$ F.·h/BTU and 32.9 $ft^{2}\cdot°$ F.·h/BTU.

Figure 5:
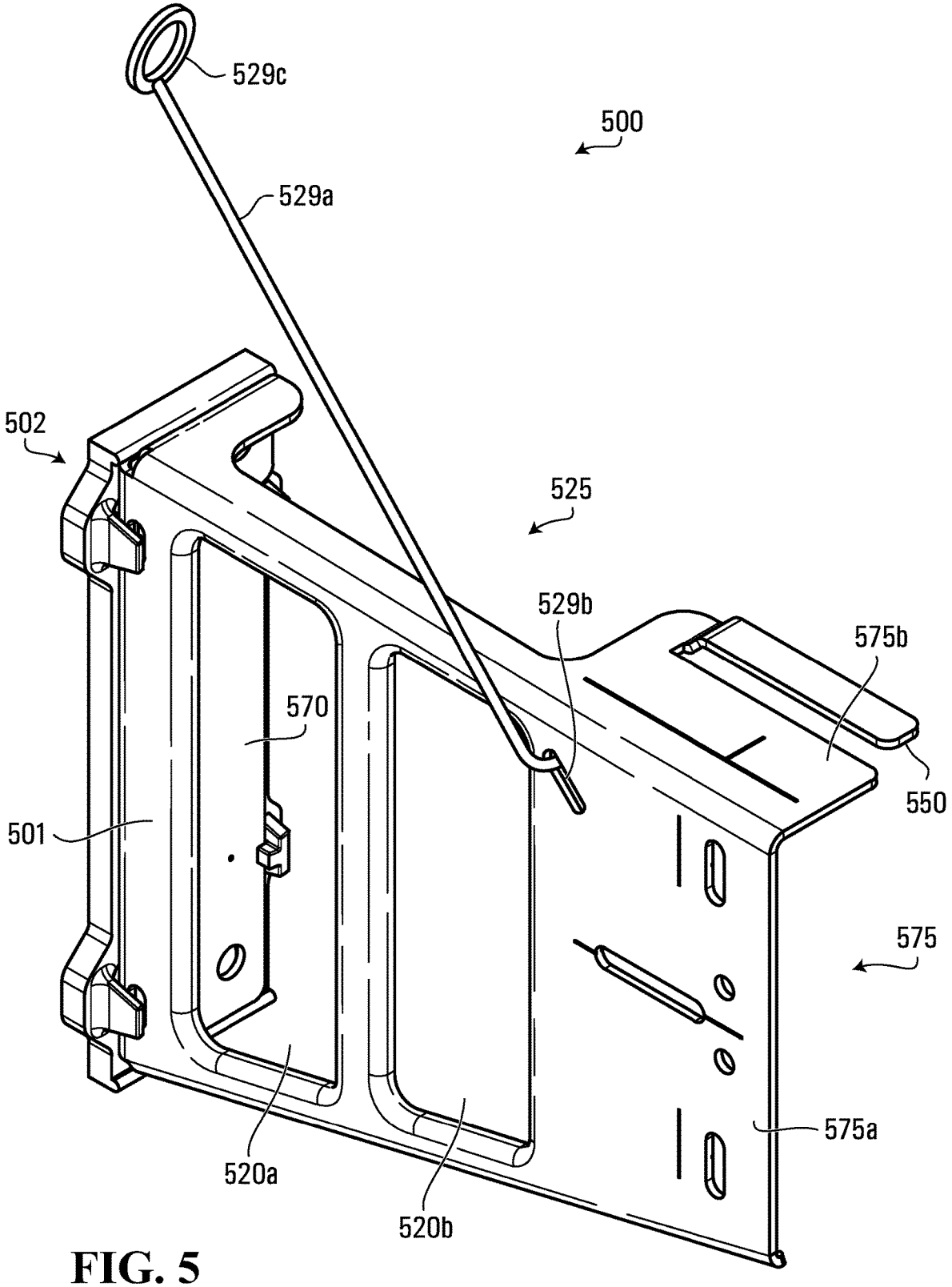
FIG. 5 is a perspective view of an alternate embodiment of a mounting clip assembly.

FIG. 5 depicts an alternate mounting clip assembly 500, which may include cavities 520*a* and 520*b* in vertical fastening plate 575*a*, enlarged cut-out 525 in horizontal fastening plate 575*b*, and a support member 529*a* connectable to slot 529*b* in vertical fastening plate 575*a*. Support member 529*a* may also include fastening hole 529*c*. Mounting clip assembly 500 may be otherwise like mounting clip assembly 100 of FIGS. 1A-4B.

Cavities 520*a* and 520*b* may remove conductive material from vertical fastening plate 575*a*. Cumulatively, cavities 520*a* and 520*b* may be between 20% and 80% of the area of vertical fastening plate 575*a*. Each cavity 520*a*, 520*b* may have an area of between about 23% and 53% of the area of vertical fastening plate 575*a*. Moreover, cavities 520*a* and 520*b* may be disposed between both first and second fastening regions and substrate fastening plate 570, such that when a sub-girt is installed either in a horizontal or vertical orientation to mounting clip assembly 500, cavities 520*a* and 520*b* may be disposed between the sub-girt and the substrate that mounting clip assembly 500 is fastened against. As will be appreciated, cavities 520*a* and 520*b* may limit the thermal conductance between substrate fastening plate 570 and the sub-girt, which may be installed either in a horizontal or vertical orientation to mounting clip assembly 500.

Multiple cavities 520*a* and 520*b* may offer increased structural integrity to mounting clip assembly 500 over a single cavity with an area equal to the cumulative area of cavities 520*a* and 520*b*. Cavities 520*a* and 520*b* may also each be reinforced for additional structural integrity, in a manner similar to that described with reference to cavity 220 (e.g. by thickening material around the periphery of cavities 520 using flanges or otherwise).

Enlarged cut-out 525 may remove conductive material from horizontal fastening plate 575*b*. Enlarged cut-out 525 may also be rectangular in shape and the width of enlarged cut-out 525 may be substantially similar to the cumulative width of cavities 520*a* and 520*b*. In other embodiments, enlarged cut-out 525 may be triangular, circular or trapezoidal in shape. In further embodiments, bracket 501 may include one or more additional cut-outs in the top of girt fastening cantilever 575, each of which may be rectangular, triangular, circular or trapezoidal in shape. In such embodiments, enlarged cut-out 525, or additional cut-outs in the top of girt fastening cantilever 575, may each also be reinforced for additional structural integrity. As will be appreciated, enlarged cut-out 525 may also limit the thermal conductance between substrate fastening plate 570 and the sub-girt, which may be installed either in a horizontal or vertical orientation to mounting clip assembly 500.

Enlarged cut-out 525 may be substantially aligned with cavities 520*a* and 520*b*, such that the thermally conductive material between enlarged cut-out 525 and cavities 520*a* and 520*b* is significantly reduced. In this way, the thermal resistance of girt fastening cantilever 575 and thus the effective R-value of mounting clip assembly 500 may also be significantly increased. For example, when a sub-girt is installed either in a horizontal or vertical orientation to mounting clip assembly 500, cavities 520*a* and 520*b* and thus enlarged cut-out 525 may interpose between the sub-girt and the substrate that mounting clip assembly 500 is fastened against. This may increase the thermal resistance between the sub-girt and the substrate that mounting clip assembly 500 is fastened against.

Support member 529*a* may be connectable to slot 529*b* in vertical fastening plate 575*a*. Support member 529*a* may be fastened to a substrate using fastening hole 529*c*, such as by inserting a screw into fastening hole 529*c* and into a substrate. Support member 529*a* may thus provide additional structural integrity to mounting clip assembly 500. For example, support member 529*a* may provide additional vertical support to mounting clip assembly 500, such that the force acting on substrate fastening plate 570 fastened to a substrate may be reduced.

As will be appreciated, mounting clip assembly 500 may offer greater structural integrity than mounting clip assembly 100 of FIGS. 1A-4B. Thus, the length of girt fastening cantilever 575 in mounting clip assembly 500 may be greater than the length of girt fastening cantilever 275 in mounting clip assembly 100. Consequently, the effective R-value of mounting clip assembly 500 may be greater than the effective R-value of mounting clip assembly 100, since the length of the thermally conductive path between a sub-girt fastened to girt fastening cantilever 575 and a substrate fastened to substrate fastening plate 570 and thermal isolation pad 502 may be increased. Moreover, the sub-girt may be disposed further away from the substrate when using mounting clip assembly 500, accommodating more insulation between the sub-girt and the substrate and thus further increasing the effective R-value of mounting clip assembly 500 relative to that of mounting clip assembly 100. For the same reasons, the effective R-value of mounting clip assembly 500 may be greater than the effective R-value of mounting clip assembly 100 because mounting clip assembly 500 may accommodate an assembly insulation thickness greater than assembly insulation thickness 498.

Of course, the above-described embodiments are intended to be illustrative only and in no way limiting. The described embodiments are susceptible to many modifications of form, arrangement of parts, details and order of operation. The invention is intended to encompass all such modification within its scope, as defined by the claims.

What is claimed is:

1. A mounting clip assembly for attaching a girt to a substrate, said mounting clip assembly comprising:

a bracket having a substrate fastening plate and a girt fastening cantilever protruding orthogonally from a first face of said substrate fastening plate;

wherein said girt fastening cantilever comprises a vertical fastening plate and a horizontal fastening plate, said horizontal fastening plate disposed orthogonally to said vertical fastening plate;

wherein said horizontal fastening plate comprises a first fastening region for fastening a girt in a horizontal orientation to said mounting clip assembly;

wherein said vertical fastening plate comprises a bottom edge that extends at an upward angle from said substrate fastening plate, such that said vertical fastening plate is substantially trapezoidal, and a second fastening region for fastening a girt in a vertical orientation to said mounting clip assembly;

wherein a cavity is formed in said vertical fastening plate at a location between said substrate fastening plate and said second fastening region to limit thermal conductance between said second fastening region and said substrate fastening plate, and wherein said cavity is reinforced;

wherein a cut-out is formed in said horizontal fastening plate and generally aligned with said cavity, along a lengthwise extent of said vertical fastening plate, and said horizontal fastening plate; and a thermal isolator pad mountable between a second face of said substrate fastening plate and said substrate.

2. The mounting clip assembly of claim 1, wherein said cavity is reinforced by thickening a periphery of said cavity.

3. The mounting clip assembly of claim 2, wherein said vertical fastening plate is formed of metal or alloy, and wherein said metal or alloy is folded to form a flange around said periphery.

4. The mounting clip assembly of claim 1, wherein said cavity is substantially trapezoidal.

5. The mounting clip assembly of claim 1, wherein said cavity has an area between 10% and 55% of the area of said vertical fastening plate.

6. The mounting clip assembly of claim 1, wherein said cut-out is formed in said horizontal fastening plate at a location between said substrate fastening plate and said first fastening region to limit thermal conductance between said first fastening region and said substrate fastening plate.

7. The mounting clip assembly of claim 1, where said bottom edge of said vertical fastening plate is reinforced.

8. The mounting clip assembly of claim 1, wherein said second fastening region comprises pre-punched holes for fastening a girt to said mounting clip assembly.

9. The mounting clip assembly of claim 1, wherein said first fastening region comprises a girt fastening slot, wherein said girt fastening slot is elevated from the surface of said horizontal fastening plate for inserting a girt in a horizontal orientation between said girt fastening slot and the surface of said horizontal fastening plate.

10. The mounting clip assembly of claim 1, said mounting clip assembly further comprising:

a first clip attached to said thermal isolator pad, wherein said first clip clasps around an edge of said substrate fastening plate; and a second clip attached to said thermal isolator pad and a pre-punched slot in said vertical fastening plate to receive said second clip.

11. The mounting clip assembly of claim 1, wherein said bracket is made of steel.

12. The mounting clip assembly of claim 1, wherein said thermal isolator pad is made of an integral glass fibre reinforced polyamide.

13. The mounting clip assembly of claim 1, where said horizontal fastening plate further comprises an embossed guideline.

14. The mounting clip assembly of claim 1, wherein a second cavity is formed in said vertical fastening plate, and wherein said second cavity is reinforced.

15. The mounting clip assembly of claim 1, wherein said mounting clip assembly further comprises a support member attached to said vertical fastening plate, for fastening to said substrate.

16. A mounting clip assembly for attaching a girt to a substrate, said mounting clip assembly comprising:

a bracket having a substrate fastening plate for mounting said bracket to a substrate, and a girt fastening plate protruding orthogonally from a first face of said substrate fastening plate;

said girt fastening plate comprising a top edge, and a bottom edge that extends at an upward angle from said substrate fastening plate, such that said girt fastening plate is substantially trapezoidal, and a fastening region for fastening a girt to said mounting clip assembly;

wherein a cavity is formed in said girt fastening plate at a location between said substrate fastening plate and said fastening region to reduce thermal conductance between said fastening region and said substrate fastening plate, wherein said cavity is reinforced by thickening material around a periphery of said cavity;

wherein a cut-out is formed in said girt fastening plate and generally aligned with said cavity, along a lengthwise extent of said girt fastening plate, to further reduce thermal conductance between said fastening region and said substrate fastening plate; and a thermal isolator pad mountable between a second face of said substrate fastening plate and said substrate.

17. The mounting clip assembly of claim 16, wherein said cavity is substantially trapezoidal.

18. The mounting clip assembly of claim 1, wherein a girt fastening slot is formed on said horizontal fastening plate at said first fastening region.

19. The mounting clip assembly of claim 18, wherein said girt fastening slot is elevated from said horizontal fastening plate, to allow a girt installed in a horizontal orientation to fit between said horizontal fastening plate and said girt fastening slot.

* * * * *